United States Patent [19]

Meschi

[11] Patent Number: 4,729,812

[45] Date of Patent: Mar. 8, 1988

[54] SERVICE APPARATUS FOR MACHINES USING CONTINUOUS STRIPS OF PAPER FORMS OR SHEETS

[76] Inventor: Luciano Meschi, Corso Amedeo 73, 57100 Livorno, Italy

[21] Appl. No.: 826,287

[22] Filed: Feb. 5, 1986

[30] Foreign Application Priority Data

Feb. 6, 1985 [IT] Italy ..... 19041 A/85

[51] Int. Cl.[4] ..... B31F 5/04; B31F 1/00

[52] U.S. Cl. ..... 156/459; 156/502; 156/510; 156/538; 493/411; 493/412; 493/414

[58] Field of Search ..... 156/459, 502, 510, 538; 271/171, 213, 217, 223; 493/411, 412, 413, 414; 270/30, 39

[56] References Cited

U.S. PATENT DOCUMENTS

| | | | |
|---|---|---|---|
| 1,817,113 | 8/1931 | Upson | 270/39 |
| 1,863,465 | 6/1932 | Borrowdale | 271/213 |
| 2,694,570 | 11/1954 | DeLano | 271/217 |
| 3,198,518 | 8/1965 | Charnley | 271/223 |
| 3,464,610 | 9/1969 | Koning | 493/411 |
| 3,640,521 | 2/1972 | Hutley | 493/412 |
| 3,697,062 | 10/1972 | Mones | 270/30 |
| 3,712,607 | 1/1973 | Ziegler | 270/39 |
| 3,936,044 | 2/1976 | Kramer | 271/171 |
| 4,406,650 | 9/1983 | Felix | 493/412 |
| 4,412,590 | 12/1983 | Meschi | 156/157 |
| 4,494,948 | 1/1985 | Teyssier | 493/412 |
| 4,507,109 | 3/1985 | Meschi | 493/413 |
| 4,508,527 | 4/1985 | Uno | 225/103 |
| 4,607,834 | 8/1986 | Dastin | 271/223 |

*Primary Examiner*—Donald E. Czaja
*Assistant Examiner*—J. Davis
*Attorney, Agent, or Firm*—McAulay, Fields, Fisher, Goldstein & Nissen

[57] ABSTRACT

Inlet and outlet service units for a printer in a service apparatus for machines using continuous strips of paper forms or sheets are combined and the inlet unit carries out the splicing of the last sheet of the pack being fed to the first sheet of the immediately following pack while the outlet unit takes care of collection, piling and accordion-like folding in packs of predetermined size and a cut to separate the strip arriving from the printer.

20 Claims, 6 Drawing Figures

SERVICE APPARATUS FOR MACHINES USING CONTINUOUS STRIPS OF PAPER FORMS OR SHEETS

The present invention relates to a service apparatus for printers or other strip form, preferably having side holes for pulling.

It is known that the printers of data processing centres and electric accounting centres are fed with forms or sheets joined together as a continuous strip and packaged in packs made up of one or more thousands of accordion-folded sheets.

With the advent of fast printers, as for example laser printers, a pack of forms or sheets is exhausted in a very short time so that the loading of a new pack of forms or sheets involves idle time which negatively affects productivity of the printer and hence in the last analysis the entire data processing line.

In recent years this problem has been faced and solved by the applicant, who has conceived and developed service equipment forming the subject matter of U.S. Pat. Nos. 4,421,590, 4,507,109 and 4,491,259.

The principal object of the present invention is a single piece of equipment in which a feed service unit for feeding a printer and a collection or outlet service unit for collection of the strips of sheets or forms leaving the printer are grouped organically.

The function of the feed service unit is to perform automatically and in time with the printer the splicing of a last sheet or form of the pack being fed to the printer with the first form or sheet of the immediately following pack in such a manner that upon exhaustion of the pack being fed the pack with which splicing was just performed replaces it automatically and there is no interruption in printer feeding. The function of the outlet service unit is to receive the strip of forms or sheets leaving the printer or the line, fold it accordion wise in a pack of predetermined size or containing a predetermined number of forms or sheets, cutting the strip of forms at the corresponding point and continuing the collection and folding without interruption of line operation.

But known units are installed in line with all the data processing equipment so that the overall space occupied is large and surveillance by several operators becomes necessary during operation with the obvious cost burden, also considering the fact that the equipment is often in operation 24 hours out of 24 hours.

Another problem connected with the equipment lies in the fact that, as for all highly automated equipment, more precautions are necessary to prevent work accidents as regards the unit which receives and wraps the packs of forms leaving the printer in which cutting and compressing means are operating.

The present invention, as mentioned above, has the object of solving the problems and drawbacks mentioned briefly above. For this purpose the present invention calls for a service apparatus for printers and in general for machines which utilize sheets or forms joined in continuous strips and folded accordion wise in packs of the type comprising a unit which splices the last sheet of a pack being fed to the printer with the first sheet of an immediately following pack and a receiving and piling unit for the sheets and forms treated in the printer characterized in that the units in arranged adjacent to the splicing unit positioned sideways and perpendicular to the receiving unit and in that in the receiving and piling unit for strips of forms leaving the printer the strip is guided and piled in a receptacle described by a bottom panel which is movable between a lowered or receiving position and a raised or compressing position, two vertical walls of which one is fixed and the other may move in an adjustable manner toward or away from the fixed wall, and two other vertical walls of which one may slide parallel to itself to allow access to said receptacle and the other vertical wall may be moved toward or away from the other vertical sliding wall, in this manner allowing the receptacle to adapt itself promptly to differing dimensions of the forms or sheets leaving the printer with no need for long and laborious adjustment.

In accordance with another aspect of the present invention the aforesaid receptacle is provided with a cutting blade device comprising a temporary supporting plane which may move transversally to the receptacle from a position in which it allows free access to the inside of the receptacle for the strip arriving from the printer and an operating position in which it intercepts the arriving strip and constitutes with its bottom surface a board for compressing the pack of forms made up in the receptacle beneath the plane, and a cutting blade shaped in such a manner as to make a paper-knife type cut of the strip of forms or sheets at a crease of the strip, said blade being connected to the temporary supporting plane in a manner movable between a withdrawn or rest position in which the blade is housed and protected in said plane with no possibility of making the cut and an operating position in which it projects in front of the temporary supporting plane in such a manner as to make the cut, there being provided first operating means for moving the temporary supporting plane between the two positions and there being provided second operating means to operate the blade between its two the positions, said second means being integral with the temporary supporting plane.

In accordance with another aspect of the present invention the strip of sheets or forms arriving from the printer is guided inside the receptacle by a rocker device comprising a pair of tension rollers in contact with each other and made to rotate in opposite directions to aid passage of the paper strip through the interference created thereby, the rollers being mounted on the lower ends of a pair of levers connected at their upper end by a running roller for the paper and pivoted thereon, one of the levers being pivoted at an intermediate point to the end of an operating connecting rod in reprocating motion, the other end of the connecting rod being pivoted to a crank made to rotate, means being also provided for adjusting the rotation radius of the crank and consequently the amplitude of the reciprocating motion of the connecting rod, the lastmentioned means being in turn engageable and disengageable.

In accordance with another aspect of the present invention the vertical wall sliding parallel to itself is made of transparent material which allows surveillance of the operation of the receiving and piling unit from outside without danger for the operator, the wall sliding in a position such as to allow access to the receptacle only when the cutting blade means have finished the cutting action and have returned to reset position and when compression of the strip of forms or sheet already piled in the receptacle and folded accordion wise has been completed.

These and other aspects and advantages of the present invention will appear more clearly from the detailed description below of a preferred embodiment given as a nonlimiting example with reference to the annexed drawings wherein.

Figure 1:
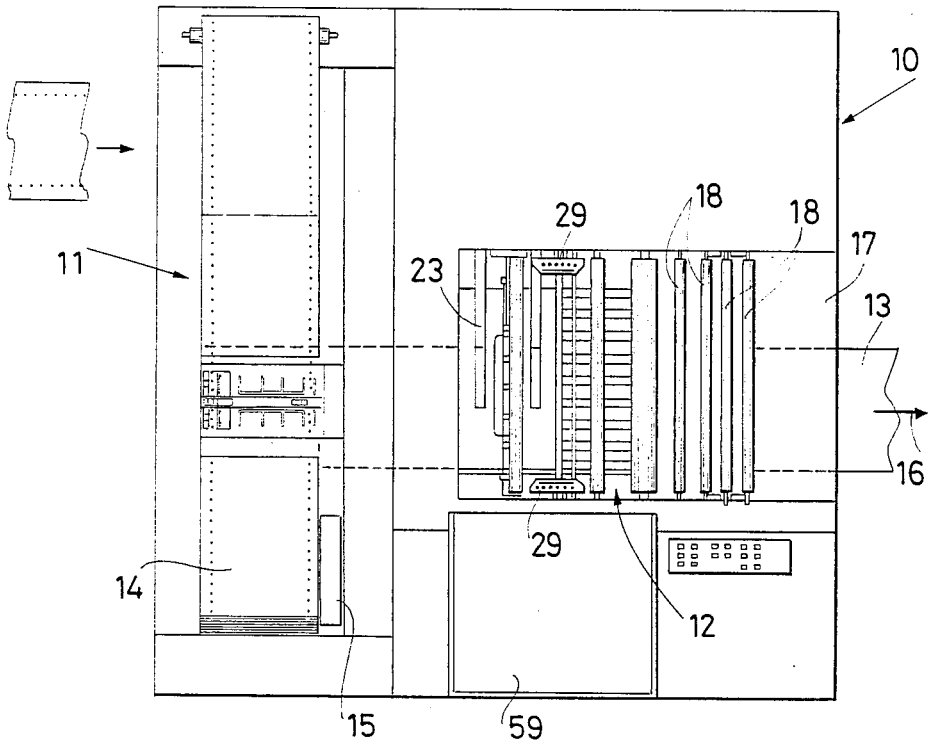
FIG. 1 is a top view of the service machine in accordance with the present invention.
Figure 2:
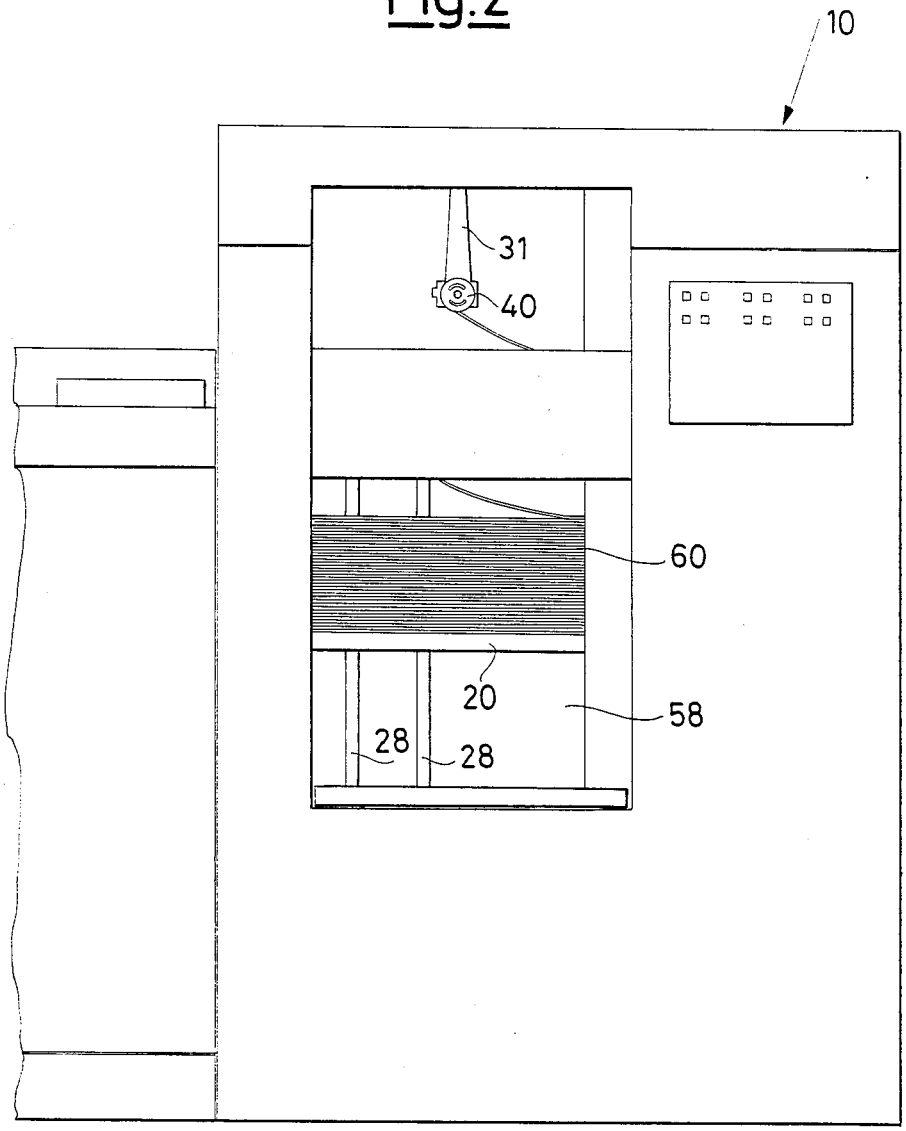
FIG. 2 is a partial side elevation view of the machine of FIG. 1 at the printer outlet service unit position.

Referring first to FIGS. 1 and 2 the service apparatus which is the subject matter of the present invention and indicated as a unit by reference number 10 comprises an inlet or splicing service unit 11 and an outlet or collection and piling service unit 12.

As can be clearly seen in FIG. 1 the two units are grouped to form a very compact machine in which two different sliding planes for the paper strip 13 to and from the printer (not shown).

More specifically in the unit 11 the splicing head makes the splice, as described in U.S. Pat. No. 4,421,590 and subsequent variants developed by the same applicant, between the last sheet of the pack being fed to the printer (not shown) and from which is unfolding the strip indicated above with reference number 13, and the first sheet of the immediately following pack, indicated schematically with reference number 14 and positioned on the supporting plane 15. As is seen in FIG. 1 the strip 13 crosses the entire machine passing above the outlet service unit 12 in the direction of the arrow 16.

To the last-mentioned unit the strip of sheets or forms then returns in the direction opposite to the direction of and beneath arrow 16, entering the outlet service unit 12 from the side 17 of the machine.

Figure 3:
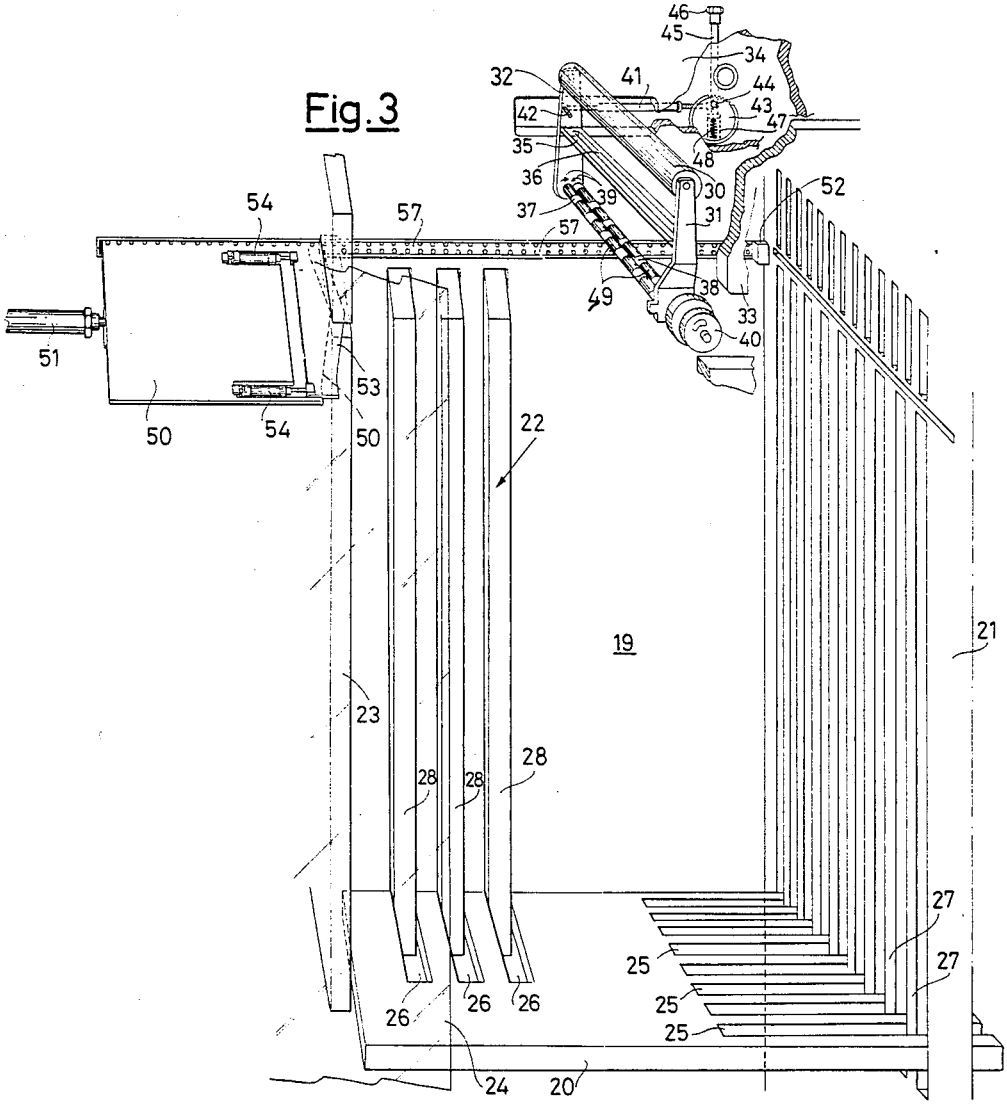
FIGS. 3 and 3A are partially sectional, perspective and elevation views of the collection and piling receptacle of the strip of forms at the printer outlet service unit position.
Figure 3A:
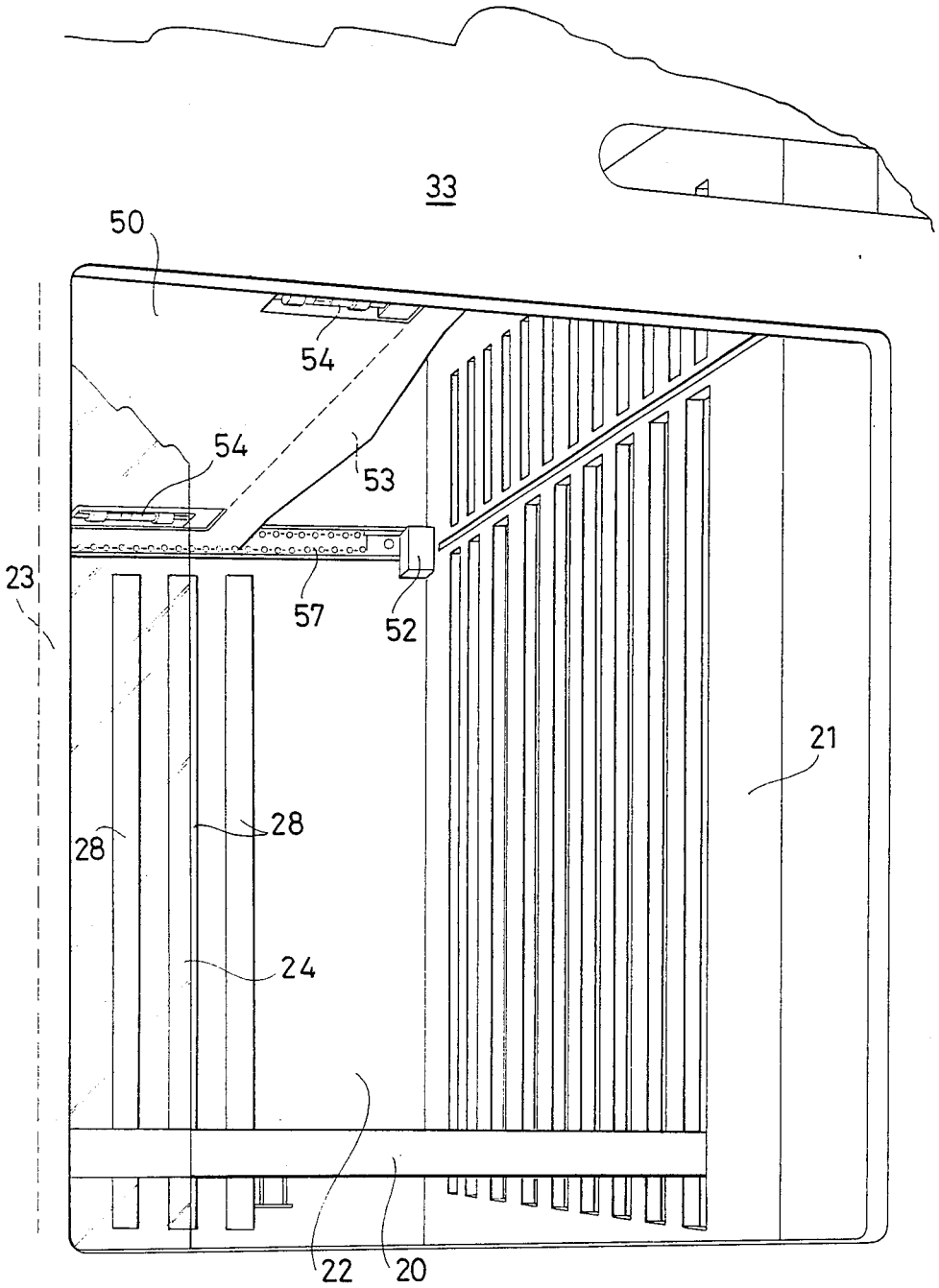
Figure 4:
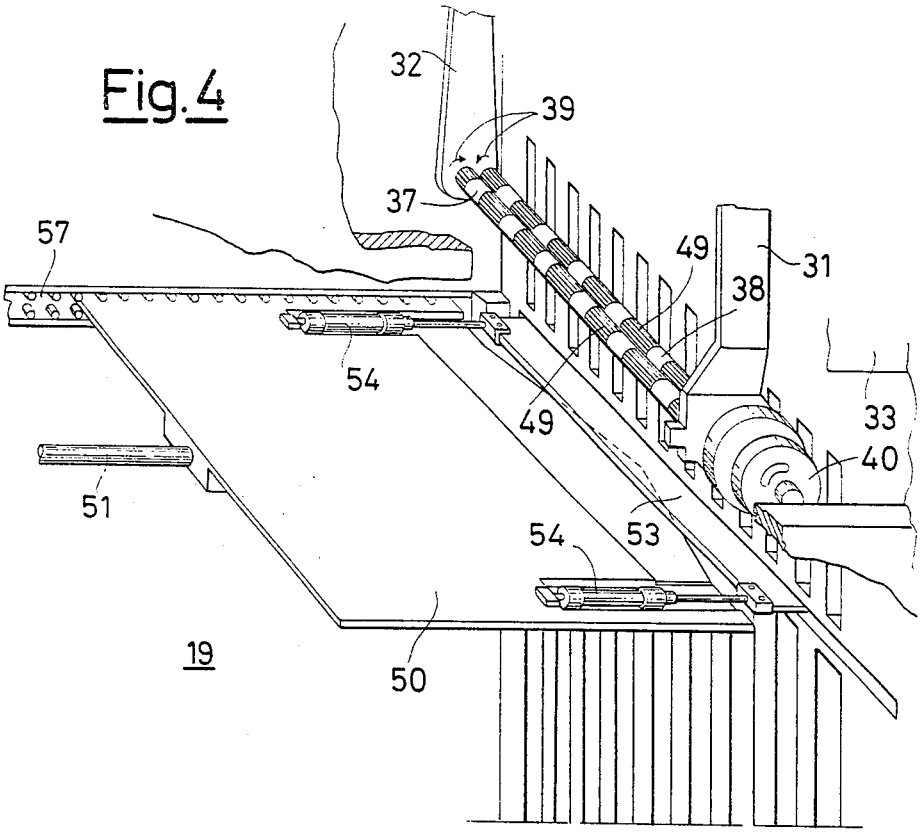
FIG. 4 is a partial view of FIG. 3 with the temporary supporting plane and cutting blade assembly in operating position.

The strip arriving from the printer crosses over the guide rollers 18 and arrives over the collection and piling receptacle 19 with accordion like folding, shown in greater detail in FIGS. 3 and 3A.

The receptacle 19 comprises a bottom plane 20 movable vertically by means not shown to perform the functions indicated in U.S. Pat. No. 4,507,109 the same applicant to which reference is made for further details.

The receptacle 19 comprises also four vertical walls 21,22,23 and 24.

Of these the wall indicated with reference number 23 is fixed and defines the greatest extension of the receptacle together with the side wall 24 which however is made of transparent material and slides parallel to its lie plane between a position in which it completely closes access to the receptacle 19 while allowing vision and inspection of its interior and a withdrawn position in which it allows access to the interior of the receptacle.

The walls indicated with reference numbers 21 and 22 are movable toward and away from the walls opposite thereto, walls 23 and 24 respectively. For this purpose in the bottom plane 20 are made two groups of slits indicated with reference numbers 25 and 26 respectively.

The wall indicated with number 21 is formed of vertical strips 27 joined together by a peripheral frame so that the wall 21 is movable along the slits 25 toward the away from the wall 23.

The wall 22 is formed partially of vertical strips 28 which slide in the slits 26 in bottom plane 20 toward and away from the transparent wall 24.

Concerning the means of moving the walls 21 and 22 for adjustment of the transverse dimension of the receptacle in accordance with the size of the forms or sheets making up the strip 13, they are conventional devices not illustrated for the sake of drawing simplicity and clarity. They are preferably motorized rack devices operated by sensors which take the aforesaid dimensions upstream from the outlet service unit.

As already mentioned the strip 13 arriving from the printer is drawn by guide rollers 18 and two drawing conveyors 29 above the receptacle 19 where it is guided and piled accordion wise by a rocker unit. It should be observed that the accordion like folding is facilitated by the fact that the strip is already folded in this manner when it comes from the pack which feeds the printer.

The rocker unit comprises a running roller 30 for the strip mounted between two side levers 31 and 32 pivoted at their upper ends to the side panels 33 and 34 of the machine. Beneath the roller 30 between the two levers 31 and 32 is mounted a horizontal bar 35 in which is made a slit 36 for passage and guiding the paper which passes beneath the bar 35 through the interference of two tension rollers 37 and 38 which are rotated in the direction of the arrows 39 by an electric motor 40 which is also integral with the lever 31 and hence with the rocker unit.

To drive the rocker unit, there is provided a mechanism comprising the connecting rod 41 whose end is made integral with the lever 32 by means of the pin 42, the other end of the connecting rod being pivoted on a gear 43 which acts as a crank one is rotated by drive means not shown. The end 44 of the connecting rod is movable in an adjustable manner along the vertical diameter of the gear 43, consequently changing the amplitude of the horizontal travel of the free end of the connecting rod 41 and hence the amplitude of oscillation of the lever 32 and of the entire rocker unit.

This adjustment is also performed in a manner dependent on the dimensions or shape of the forms or sheets composing the strip 13.

For this purpose a device is provided comprising a vertical rod 45 fitted with a handgrip 46, the lower end of the rod being movable in a box 47 against the counteraction of a compression spring 48. The rod 45 is connected to the end 44 of the connecting rod.

Consequently the position assumed by the rod 45 in its relationship with the box 47 establishes the position and the distance from the centre of the end 44 of the connecting rod with respect to the gear 43.

It should be observed that the rollers 37 have zones 49 of nonslip material so that the strip of paper cannot slide back.

As a height intermediate between the rollers 37 and the inside of the receptacle 19 is mounted the temporary supporting plane and blade unit.

This unit comprises a plane 50 which can move between a position in which it is completely withdrawn without interfering with the upper opening of the receptacle 19 and an operating position in which it intercepts the strip of forms or sheets arriving through the rollers 37 so that the strip 13 instead of being deposited on the bottom plane 20 piles up on the plane 50.

This happens when on the bottom plane 20 a predetermined height of forms or sheets (always joined in a continuous strip and folded accordion wise) has been piled so that the strip must be cut and the pack of sheets thus formed on the plane 20 removed.

The plane 50 in the operative position as described in the aforesaid U.S. Pat. No. 4,507,109 also serves as a stop or fixed support for compressing the pile formed on the plane 20 before cutting.

To move the plane 50, there is provided a jack or compressed air cylinder 51 the stem of which is integral with the rear edge of the plane 50. A pin 52 stops the travel of the plane 50. The plane 50 also constitutes the support of the cutting blade 53 which is shaped in such a manner that engagement with the end of the crease between two sheets of the strip 13 takes place first at one point and the cut thus takes place with a "paper-knife" effect.

Figure 5:
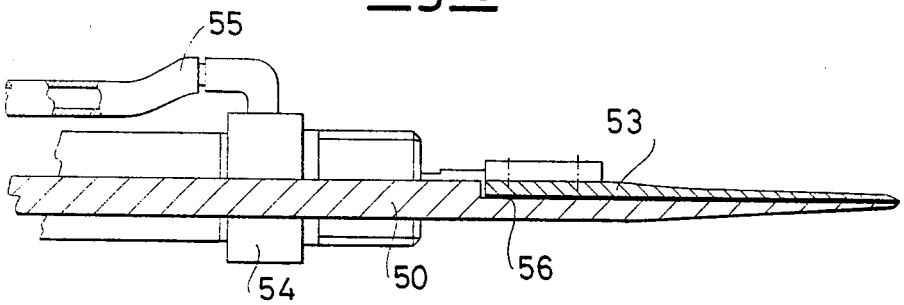
FIG. 5 is a longitudinal section of the cutting blade assembly.

As can be clearly seen in FIG. 5 the plane 50 is tapered at its front edge while in its thickness is cut a seat 56 to house the blade 53 in a disappearing manner.

To move the blade 53 between the withdrawn position in the thickness of the plane 50 and the cutting position, there is provided a pair of compressed air cylinders 54 connected by a flexible hose 55 and a source of pressure and vacuum (not shown).

To facilitate sliding of the blade with respect to the plane 50 a coat of antifriction material is applied on the seat 56.

On the side walls 33 and 34, there are provided guides 57 for the sliding of the plane 50 parallel to itself.

As can be appreciated from FIGS. 1,2 and 3 an important feature of the machine in accordance with the present invention lies in the fact that the temporary supporting plane and related blade in the rest position disappear beneath the upper plane of the splicing unit to reduce occupied space.

As shown in FIG. 2, in the body of the machine is made an opening 58 corresponding to the sliding transparent wall 24 opposite which is made a plane 59 (FIG. 1) on which the pack 60 formed on the plane 20 compressed and separated from the rest of the strip arriving from the printer is moved by expulsion to then be carried away.

The invention has been described in relation to some peculiar and preferred aspects it being understood that conceptually and mechanically equivalent modifications and variants are possible and foreseeable without exceeding its scope.

Concerning the general functions of the inlet service unit (11) and outlet service unit (12) reference is made to the aforementioned patents.

I claim:

1. Service apparatus for machines using sheets or forms joined in continuous strips and folded accordion-wise in packs, each of said packs having a first sheet and a last sheet, the first sheet being the initial sheet of each said pack fed to a printer, and the last sheet of an immediately preceeding pack being splicable with the first sheet of the next succeeding immediately following pack fed to the printer, comprising:

a splicing unit for splicing the last sheet of the immediately preceeding pack being fed to the printer with the first sheet of the next succeeding immediately following pack;

an outlet unit for receiving and piling sheets or forms treated in the printer, said outlet unit being arranged adjacent to said splicing unit and being positioned transversely to said splicing unit;

a receptacle below said outlet unit;

outlet unit means for receiving and piling the forms leaving the printer for guiding the strip and piling thereof into said receptacle;

said receptacle having a bottom panel which is movable between a lowered or receiving position and a raised or compressing position, a first set of two oppositely disposed vertical walls, one of which is fixed and the other of which is movable in an adjustable manner toward or away from said fixed wall, and a second set of two oppositely disposed vertical walls substantially orthogonal to said first set of two vertical walls, both of which are movable and one of said walls of said second set of walls moves parallel to the fixed wall of said first set of walls to allow size adjustment of said receptacle and said other movable wall of said second set slides transversely of said fixed wall of said first set to allow access to said receptacle.

2. Service apparatus in accordance with claim 1, wherein the sheets or forms have a crease between adjacent sheets or forms folded accordion-wise, and including:

a cutting blade device for said receptacle, said cutting blade device comprising a temporary supporting plane and a cutting blade;

said temporary supporting plane moving transversely to said receptacle between a position in which it allows free access to the interior of said receptacle for the strip arriving from the printer and a operating position in which it intercepts the strip arriving and constitutes with its lower surface a stop or board for compression of the pack of forms created in the receptacle beneath said plane;

said cutting blade being shaped in such a manner as to make a "paper-knife" cut of the strip of forms or sheets at one of the creases in said strip of said sheets or forms joined in strips and folded accordian-wise;

said blade being connected to said temporary supporting plane and being movable between a withdrawn or rest position in which the blade is housed or protected in said plane with no possibility of making the cut and an operating position in which it protrudes from the front of said temporary supporting plane in order to make said cut; and first operating means for moving said temporary supporting plane between its two said positions; and second operating means to move said blade between its said two positions, said second means being integral with said temporary supporting plane.

3. Service apparatus in accordance with claim 1, including:

a rocker device for guiding the strip of sheets or forms arriving from the printer into said receptacle;

a connecting rod for driving said rocker device;

said rocker device, comprising:

a pair of tension rollers in mutual contact and rotated in opposite directions to aid passage of the strip of paper through interferences created thereby;

said rollers being mounted on lower ends of a pair of levers connected at their upper ends by a paper strip supporting roller and hinged thereto; and one of said levers being pivoted in an intermediate position to the end of said connecting rod in reciprocating motion, and the other end of said connecting rod being pivoted to a crank which is made to rotate; and including means for adjusting the radius of rotation of said crank and consequently the amplitude of the reciprocal motion of said connecting rod, said last mentioned means being in turn engageable and disengageable.

4. Service apparatus in accordance with claim 2, wherein said strip of sheets or forms arriving from the printer is guided inside said receptacle by a rocker device and a connecting rod for driving said rocker device, said rocker device, comprising:

a pair of tension rollers in mutual contact and rotated in opposite directions to aid passage of the strip of paper through interferences created thereby;

said rollers being mounted on lower ends of a pair of levers connected at their upper ends by a paper strip supporting roller and hinged thereto;

one of said levers being pivoted in an intermediate position to the end of said connecting rod in reciprocating motion, the other end of said connecting rod being pivoted to a crank which is made to rotate; and means for adjusting the radius of rotation of said crank and consequently the amplitude of the reciprocal motion of said connecting rod, said last mentioned means being in turn engageable and disengageable.

5. Service apparatus in accordance with claim 3, wherein said rollers have zones coated with anit-slip material.

6. Service apparatus in accordance with claim 1, wherein said other vertical wall of said second set is made of transparent material.

7. Service apparatus in accordance with claim 2, wherein said first operating means for said plane for movement thereof between said two positions are compressed air cylinders.

8. Service apparatus in accordance with claim 2, wherein said second operating means for said blade for movement thereof between said two positions includes compressed air cylinders.

9. Service apparatus in accordance with claim 1, wherein said bottom plane has two groups of slits, all of the slits in each respective group are parallel with each other, and the slits of one group are orthogonally arranged relative to the slits of the other group.

10. Service apparatus as claimed in accordance with claim 1, wherein each of said movable walls are formed at least partially by vertical bars.

11. Apparatus in accordance with claim 9, wherein each of said movable walls includes vertical bars passing into said slits and are guided for movement by said slits.

12. Service apparatus in accordance with claim 2, wherein one of said blade positions coincides with one of said blade temporary supporting positions.

13. Service apparatus for machines using sheets or forms joined in continuous strips and folded accordion-wise in packs, each of said packs having a first sheet and a last sheet, the first sheet being the initial sheet of each said pack fed to a printer, and the last sheet of an initial pack being splicable with the first sheet of the next succeeding immediately following pack fed to the printer, and having a splicing unit for splicing the last sheet of the included pack being fed to the printer with the first sheet of an immediately following pack, comprising:

an outlet unit for receiving and piling sheets or forms treated in the printer, said outlet unit being arranged adjacent to said splicing unit;

a receptacle below said outlet unit;

outlet unit means for receiving and piling the forms leaving the printer for guiding the strip and piling thereof into said receptacle;

said receptacle including:

a bottom panel movable between a lowered or receiving position and a raised or compressing position;

a first set of two spaced vertical walls, one of which is fixed and the other of which is movable in an adjustable manner toward or away from said fixed wall; and a second set of two spaced vertical walls substantially orthogonal to said first set of two vertical walls, one of which is movable and the other of which is slideable and slides transverse to the fixed wall of said first set of walls to allow access to said receptacle, and said movable wall of said second moves towards or away from said slidable wall of said second set to allow size adjustment of said second set and wherein said sheets or forms have a crease between adjacent sheets or forms folded accordion-wise to fit within said receptacle after its size is adjusted.

14. Service apparatus in accordance with claim 13, including:

a cutting blade device for said receptacle, said cutting blade device comprising a temporary supporting plane and a cutting blade;

said temporary supporting plane moving transversely to said receptacle between a position in which it allows free access to the interior of said receptacle for the strip arriving from the printer and an operating position in which it intercepts the strip arriving and constitutes with its lower surface a stop or board for compression of the pack of forms created in the receptacle beneath said plane;

said cutting blade being shaped in such a manner as to make a "paper-knife" cut of the strip of forms or sheets at a juncture of said sheets or forms joined in strips and folded accordion-wise;

said blade being connected to said temporary supporting plane and being movable between a withdrawn or rest position in which the blade is housed or protected in said plane without any possibility of making the cut and an operating position in which it protrudes from the front of said temporary supporting plane in order to make said cut; and first operating means being provided for moving said temporary supporting plane between its two said positions; and second operating means being provided to move said blade between its said two positions, said second means being integral with said temporary supporting plane.

15. Service apparatus in accordance with claim 14, including a rocker device for guiding the strip of sheets or forms arriving from the printer into said receptacle;

a connecting rod for driving said rocker device;

said rocker device comprising a pair of tension rollers in mutual contact and rotated in opposite directions to aid passage of the strip of paper through interferences created thereby, said rollers being mounted on lower ends of a pair of levers connected at their upper ends by a paper strip supporting roller and hinged thereto, one of said levers being pivoted in an intermediate position to the end of said connecting rod in reciprocating motion, the other end of said connecting rod being pivoted to a crank which is made to rotate; and means also being provided for adjusting the radius of rotation of said crank and consequently the amplitude of the reciprocal motion of said connecting rod, said last mentioned means being in turn engageable and disengageable.

16. Service apparatus in accordance with claim 14, wherein one of said blade positions coincides with one of said blade temporary supporting positions.

17. Service apparatus in accordance with claim 13, wherein said slidable vertical wall of said second set is made of transparent material.

18. Service apparatus in accordance with claim 14, wherein said first and second operating means are compressed air cylinders.

19. Service apparatus in accordance with claim 13, wherein said bottom plane has two groups of slits, all of said slits in each respective group being parallel with each other, and said slits of one group being orthogonally arranged relative to the slits of the other group, and each of said movable walls includes vertical bars passing into said slits and guided for movement by said slits.

20. Apparatus as claimed in accordance with claim 13, wherein each of said movable walls are at least partially formed by vertical bars.

* * * * *